US006729853B2

(12) United States Patent
Umemura et al.

(10) Patent No.: US 6,729,853 B2
(45) Date of Patent: May 4, 2004

(54) DISPLACEMENT CONTROL DEVICE FOR VARIABLE DISPLACEMENT COMPRESSOR

(75) Inventors: Satoshi Umemura, Kariya (JP); Tomoji Tarutani, Kariya (JP); Tatsuya Hirose, Kariya (JP); Yuji Hashimoto, Kariya (JP); Ryo Matsubara, Kariya (JP); Masaki Ota, Kariya (JP)

(73) Assignee: Kabushiki Kaisha Toyota Jidoshokki, Kariya (JP)

( * ) Notice: Subject to any disclaimer, the term of this patent is extended or adjusted under 35 U.S.C. 154(b) by 40 days.

(21) Appl. No.: 10/236,527

(22) Filed: Sep. 5, 2002

(65) Prior Publication Data

US 2003/0044291 A1 Mar. 6, 2003

(30) Foreign Application Priority Data

Sep. 5, 2001 (JP) ..... 2001-269186

(51) Int. Cl.[7] ..... F04B 1/26

(52) U.S. Cl. ..... 417/222.2; 417/222.1; 417/222.3

(58) Field of Search ..... 417/222.1, 222.2, 417/222.3, 287

(56) References Cited

U.S. PATENT DOCUMENTS 5,529,461 A * 6/1996 Kawaguchi et al. ..... 417/222.2
5,577,894 A * 11/1996 Kawaguchi et al. ..... 417/222.2
5,606,610 A * 2/1997 Johansson ..... 713/193
5,681,150 A * 10/1997 Kawaguchi et al. ..... 417/222.2
5,785,502 A * 7/1998 Ota et al. ..... 417/222.2
6,263,687 B1 * 7/2001 Ban et al. ..... 62/228.3
6,354,811 B1 * 3/2002 Ota et al. ..... 417/222.2
6,358,017 B1 * 3/2002 Ota et al. ..... 417/222.2
6,361,283 B1 * 3/2002 Ota et al. ..... 417/222.2
6,517,323 B2 * 2/2003 Kimura et al. ..... 417/222.2
6,595,015 B2 * 7/2003 Fujii et al. ..... 62/228.3

FOREIGN PATENT DOCUMENTS

| | | |
|---|---|---|
| EP | 1 070 845 | 1/2001 |
| JP | 6-147109 | 5/1994 |
| JP | 7-127569 | 5/1995 |

* cited by examiner

*Primary Examiner*—Justine R. Yu
*Assistant Examiner*—William H. Rodriguez
(74) *Attorney, Agent, or Firm*—Morgan & Finnegan, LLP

(57) ABSTRACT

A first bleed passage and a second bleed passage each connect a crank chamber of a compressor with a suction chamber of the compressor. A first supply passage and a second supply passage each connect the crank chamber with a discharge chamber of the compressor. A first control valve adjusts the opening size of the first supply passage in response to the pressure in the suction chamber. A second control valve includes a ball valve and an electromagnetic actuator. The ball valve adjusts the opening size of the second supply passage and the opening size of the first bleed passage. The electromagnetic actuator moves the ball valve. The ball valve is moved to a first position and to a second position. At the first position, the ball valve closes the second supply passage and opens the first bleed passage. At the second position, the ball valve opens the second supply passage and closes the first bleed passage. A displacement control device, which includes the first and second control valves, readily and reliably changes the displacement of the compressor.

20 Claims, 3 Drawing Sheets

DISPLACEMENT CONTROL DEVICE FOR VARIABLE DISPLACEMENT COMPRESSOR

BACKGROUND OF THE INVENTION

The present invention relates to a variable displacement compressor comprising a refrigerant circuit of an on-vehicle air conditioner.

Generally, a compressor for an on-vehicle air conditioner has a clutch mechanism such as an electromagnetic clutch on a power transmission path between an engine, which is a drive source of the vehicle, and the compressor. When the air-conditioning is not necessary, the electromagnetic clutch is disengaged and the power is not transmitted to the compressor to stop the compressor.

However, when the electromagnetic clutch is engaged and disengaged, shock is caused, and the shock decreases the drivability of the vehicle. Therefore, recently, clutchless type compressors have been widely used. (for example, Japanese Laid-Open Patent Publication No. 7-127569) A clutchless type compressor does not have a clutch mechanism on the power transmission path between the engine and the compressor.

A variable displacement swash plate type compressor is used as a clutchless type compressor that is disclosed in the above publication. In the variable displacement swash plate type compressor, displacement can be changed based on pressure in a crank chamber, which is a swash plate accommodating chamber. In the compressor, the crank chamber and a suction chamber are connected by a bleed passage. The discharge chamber and the crank chamber are connected by a first supply passage and a second supply passage. A pressure sensitive valve is arranged in the first supply passage. The pressure sensitive valve operates by mechanically sensing the suction pressure. An electromagnetic valve is arranged in the second supply passage. The electromagnetic valve closes the second supply passage when the air-conditioning is necessary.

Therefore, when the pressure sensitive valve is operated according to changes in the suction pressure, balance is controlled between the flow rate of high pressure discharge gas introduced to the crank chamber via the first supply passage and the flow rate of gas discharged from the crank chamber via the bleed passage. The pressure in the crank chamber is thus determined.

When the air-conditioning is not necessary or the engine is running with a large load such as when the vehicle is accelerated or running at high speed, the second supply passage is opened by the electromagnetic valve. The crank chamber is maintained with high pressure regardless of the opening adjustment of the first supply passage by the pressure sensitive valve. The displacement of the compressor becomes minimum. Therefore, the compressor drive load of the engine is controlled to be minimum.

However, the bleed passage is always open in the above compressor and refrigerant gas is always introduced to the suction chamber by the bleed passage. The flow of the refrigerant gas introduced to the crank chamber by the first and the second supply passages needs to be large so that the crank chamber is maintained with high pressure to keep the minimum displacement of the compressor. Therefore, the minimum displacement of the compressor needs to be set large and the engine load necessary for driving the compressor increases. Since refrigerant gas of a large flow rate needs to be passed through the first and second supply passages, the sizes of the pressure sensitive valve and the electromagnetic valve need to be increased.

A cross-sectional area of the bleed passage may be smaller to solve the above problem. However, if the cross-sectional area of the bleed passage is small, the refrigerant gas is introduced from the crank chamber to the suction chamber slowly. The pressure of the crank chamber cannot be lowered rapidly. In other words, the displacement of the compressor cannot be increased rapidly.

SUMMARY OF THE INVENTION

Accordingly, it is an objective of the present invention to provide a displacement control device of a variable displacement compressor, which device has a small drive load at a minimum displacement and a compact valve for controlling the displacement, and also is capable of changing the compressor displacement rapidly.

To achieve the foregoing and other objectives and in accordance with the purpose of the present invention, a displacement control device for a variable displacement compressor in a refrigerant circuit of a vehicular air conditioner is provided. The compressor is driven by a drive source of the vehicle to compress refrigerant. The refrigerant circuit includes a low pressure zone and a high pressure zone. The low pressure zone is exposed to the pressure of refrigerant drawn into the compressor. The high pressure zone is exposed to the pressure of refrigerant compressed by the compressor. The displacement control device adjusts the pressure in a crank chamber of the compressor, thereby changing the displacement of the compressor. The control device includes a bleed passage, first and second supply passages, a first control valve, and a second control valve. The bleed passage connects the crank chamber with the low pressure zone. The first and second supply passages connect the crank chamber with the high pressure zone. The first and second supply passages are formed independent from each other. The first control valve is located in the first supply passage. The first control valve adjusts the opening size of the first supply passage and includes a pressure sensitive member and a valve body. The pressure sensitive member is displaced in response to a pressure in the refrigerant circuit. The valve body is moved by the pressure sensitive member. In response to a pressure in the refrigerant circuit, the pressure sensitive member moves the valve body such that the displacement of the compressor is changed to cancel pressure fluctuation of a pressure in the refrigerant circuit. The second control valve is located in the second supply passage and in the bleed passage. The second control valve operates in response to an external command and includes a first valve portion and a second valve portion. The first valve portion adjusts the opening size of the second supply passage, and the second valve portion adjusts the opening size of the bleed passage. When the first valve portion decreases the opening size of the second supply passage, the second valve portion increases the opening size of the bleed passage. When the first valve portion increases the opening size of the second supply passage, the second valve portion decreases the opening size of the bleed passage.

Other aspects and advantages of the invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF THE PREFERRED EMBODIMENTS

Hereinafter, one embodiment of the present invention will be described referring to FIGS. 1 to 4.

Figure 1:
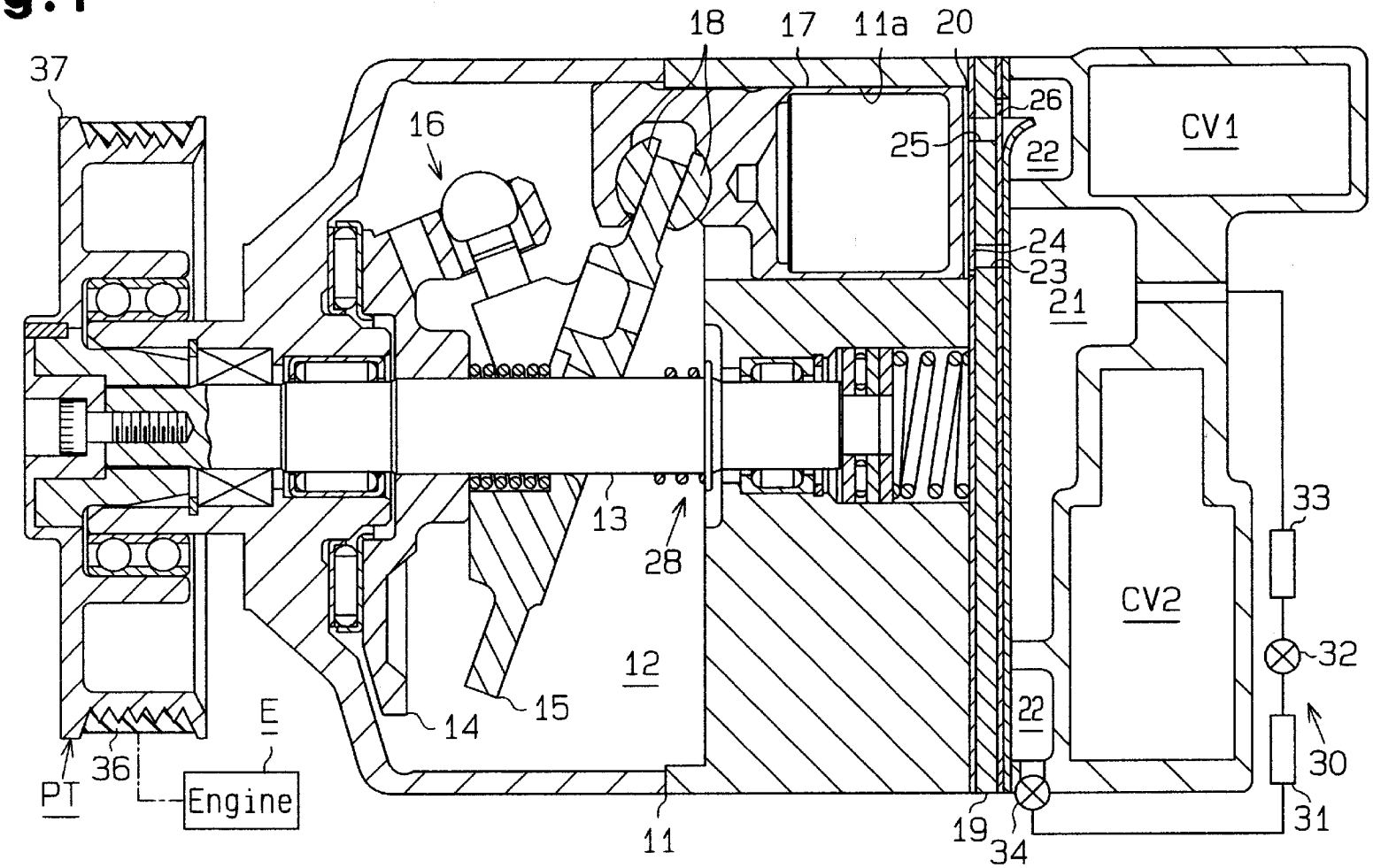
FIG. 1 is a cross sectional view illustrating a variable displacement swash plate type compressor according to one embodiment of the present invention.

As shown in FIG. 1, a crank chamber 12 is defined in a housing 11 of a variable displacement swash plate type compressor. A drive shaft 13 is rotatably arranged in the crank chamber 12. The drive shaft 13 is connected to an engine E, which is a drive source of a vehicle, via a power transmission mechanism PT. The drive shaft 13 is rotated by power from the engine E. The power transmission mechanism PT is comprised of a clutchless mechanism that always transmits power. The clutchless mechanism includes a belt 36 and a pulley 37. The drive shaft 13 is always rotated when the engine E is running.

A lug plate 14 is fixed to the drive shaft 13 in the crank chamber 12 to be rotated integrally with the drive shaft 13. A cam plate, which is a swash plate 15 in this embodiment, is provided in the crank chamber 12. The swash plate 15 is movable to slide and incline with respect to the drive shaft 13. A hinge mechanism 16 is arranged between the lug plate 14 and the swash plate 15. The swash plate 15 is rotatable in synchronism with the lug plate 14 and the drive shaft 13 via the hinge mechanism 16, and the swash plate 15 is movable to incline with respect to the drive shaft via the hinge mechanism 16.

Cylinder bores 11*a* (only one is shown in the drawing) are formed in the housing 11. A single-headed piston 17 is accommodated in each cylinder bore 11*a*. Each piston 17 is engaged with the peripheral portion of the swash plate 15 with shoes 18. Rotation of the swash plate 15 corresponding to rotation of the drive shaft 13 is converted to a reciprocation of the pistons 17 by the shoes 18.

A compression chamber 20 is defined on the rear side (the right side in the drawing) of each cylinder bore 11*a* by the associated piston 17 and a valve plate assembly 19, which is provided in the housing 11. The valve plate assembly 19 has suction ports 23, suction valve flaps 24, discharge ports 25 and discharge valve flaps 26. Each set of the suction port 23, the suction valve flap 24, the discharge port 25 and the discharge valve flap 26 corresponds to one of the cylinder bores 11*a*. A suction chamber 21 and a discharge chamber 22 are defined on the further rear side of the housing 11.

When each piston 17 moves from the top dead center position to the bottom dead center position, refrigerant gas in the suction chamber 21 is drawn into the compression chamber 20 through the corresponding suction port 23 while flexing the suction valve flap 24. When the piston 17 moves from the bottom dead center position to the top dead center position, the refrigerant gas drawn into the compression chamber 20 is compressed to a predetermined pressure. Then the refrigerant gas is discharged to the discharge chamber 22 via the corresponding discharge port 25, while flexing the discharge valve flap 26.

The above compressor changes the displacement by adjusting the pressure in the crank chamber 12. That is, the difference between the pressure in the crank chamber 12 and the pressure in the compression chamber 20 is changed in accordance with changes in the pressure in the crank chamber 12. Accordingly, the inclination angle of the swash plate 15 is changed and the stroke of the piston 17, that is, the displacement of the compressor is adjusted.

For example, when the pressure in the crank chamber 12 is decreased, the inclination angle of the swash plate 15 is increased and the displacement of the compressor is increased. When the swash plate 15 contacts the lug plate 14 and the inclination of the swash plate 15 is define by the lug plate 14 as shown in FIG. 1, the inclination angle is maximum. On the other hand, when the pressure in the crank chamber 12 is increased, the inclination angle of the swash plate 15 is decreased and the displacement of the compressor is decreased. The minimum inclination angle of the swash plate 15, which is greater than zero degrees, is defined when the swash plate 15 contacts a minimum inclination angle restricting member 28 arranged on the drive shaft 13.

As shown in FIG. 1, a refrigerant circuit (refrigerating cycle) of the on-vehicle air conditioner is comprised of the above-described compressor and an external refrigerant circuit 30. The external refrigerant circuit 30 includes a condenser 31, an expansion valve 32 and an evaporator 33.

In the refrigerant circuit, a shutoff valve 34 is arranged on a refrigerant passage between the discharge chamber 22 of the compressor and the condenser 31. The shutoff valve 34 functions as a circulation stopping device. When the pressure in the discharge chamber 22 becomes lower than a predetermined value, the shutoff valve 34 shuts off the refrigerant passage and stops the circulation of the refrigerant via the external refrigerant circuit 30.

The shutoff valve 34 may be a differential valve type, which is operated by mechanically detecting the pressure difference, or an electromagnetic valve type, which is controlled by an external device according to a detection value detected by a discharge pressure sensor (not shown). The shutoff valve 34 may be a valve that is mechanically moved by the swash plate 15 at its minimum inclination angle and shuts off the refrigerant passage.

Figure 2:
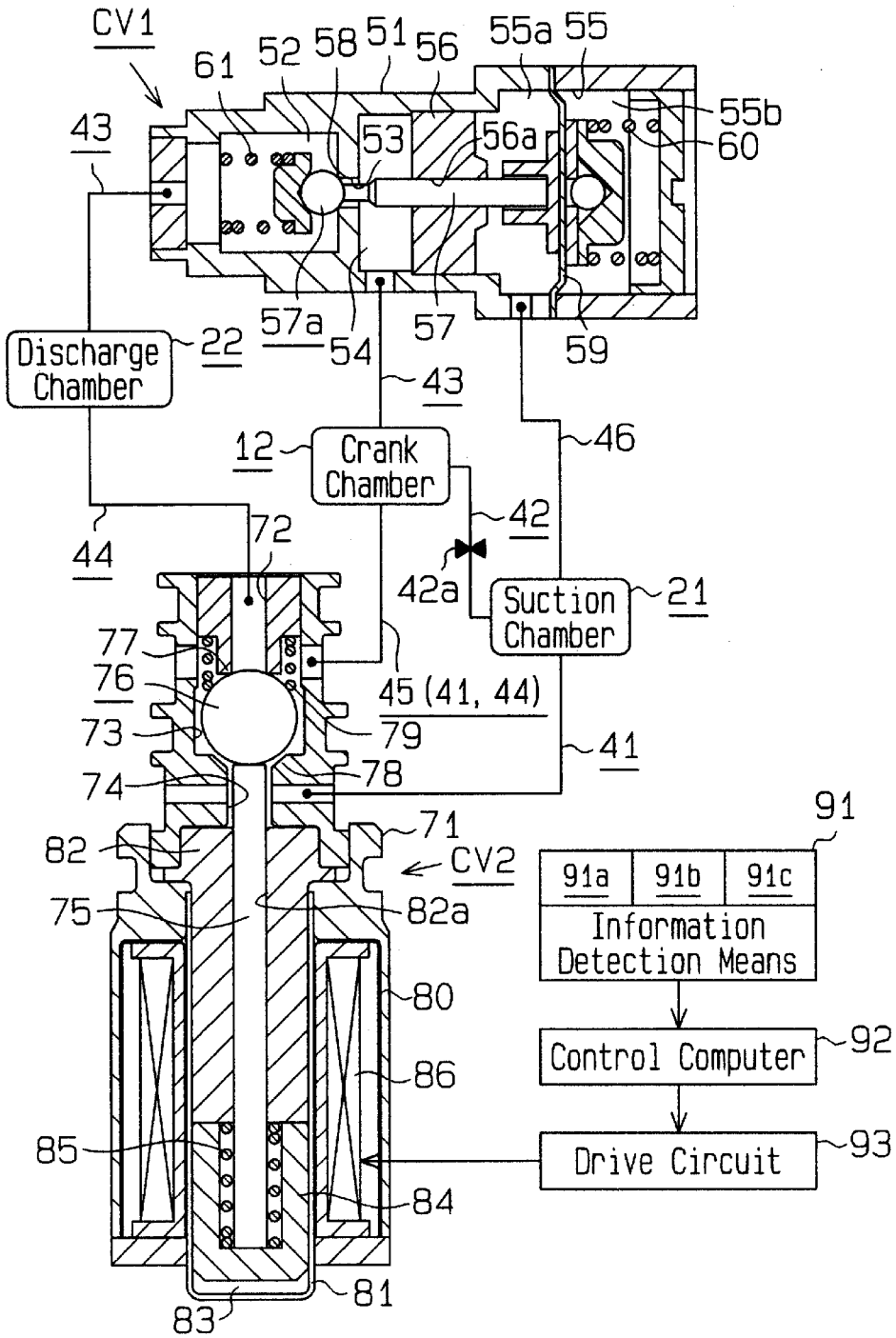
FIG. 2 is a view showing a displacement control device of the compressor shown in FIG. 1.

As shown in FIG. 2, bleed passages 41, 42 and supply passages 43, 44 are formed in the housing 11 of the compressor. The first and second bleed passages 41, 42 each connect the crank chamber 12 with a suction pressure zone (a low pressure zone), which is the suction chamber 21 in this embodiment. The first and second supply passages 43, 44 are independent from each other, and each connect a discharge pressure zone (a high pressure zone), which is the discharge chamber 22 in this embodiment, with the crank chamber 12.

A first control valve CV1 is arranged in the first supply passage 43 and is located in the housing 11. The first control valve CV1 adjusts the opening size of the first supply passage 43. A second control valve CV2 is arranged in the first bleed passage 41 and the second supply passage 44 and is located in the housing 11. The second control valve CV2 adjusts the opening size of each of the passages 41 and 44. The first bleed passage 41 and the second supply passage 44 have a common passage between the second control valve CV2 and the crank chamber 12 (common passage 45).

The second bleed passage 42 always communicates the crank chamber 12 with the suction chamber 21. A fixed restrictor 42*a* is arranged in the second bleed passage 42. The second bleed passage 42 may be an aperture formed in the housing 11 or a space between the parts positioned between the crank chamber 12 and the suction chamber 21.

The sum of the cross-sectional area of the first and the second bleed passages 41, 42 at the time when the first bleed passage 41 is fully opened is substantially the same as the cross-sectional area of one bleed passage of a prior art (Japanese Laid-Open Patent Publication No. 7-127569).

As shown in FIG. 2, a valve chamber 52, a communication passage 53, a communication chamber 54, and a pressure sensitive chamber 55 are defined in a valve housing 51 of the first control valve CV1. The valve chamber 52 is communicated with the communication chamber 54 via the communication passage 53. In the valve housing 51, a through hole 56*a* is formed in a partition wall 56 that defines the communication chamber 54 and the pressure sensitive chamber 55. An operation rod 57 is inserted to the communication passage 53 and the through hole 56*a* so as to be movable in its axial direction (the horizontal direction in the drawing). The communication chamber 54 and the pressure sensitive chamber 55 are shut off from each other by the insertion of the operation rod 57 to the through hole 56*a*.

The valve chamber 52 is communicated with the discharge chamber 22 via an upstream section of the first supply passage 43. The communication chamber 54 is communicated with the crank chamber 12 via a downstream section of the first supply passage 43. The valve chamber 52, the communication passage 53 and the communication chamber 54 form a part of the first supply passage 43. In the housing 51, a spherical valve body (a first valve body) 57*a* is arranged on the left end of the operation rod 57. In the housing 51, a step defined between the valve chamber 52 and the communication passage 53 functions as a valve seat 58. The communication passage 53 serves as a valve aperture.

A pressure sensitive member 59 of a diaphragm is arranged in the pressure sensitive chamber 55. The pressure sensitive chamber 55 is divided into a first pressure chamber 55*a* and a second pressure chamber 55*b* by the pressure sensitive member 59. The first pressure chamber 55*a* is communicated with the suction chamber 21 via a pressure introduction passage 46. The second pressure chamber 55*b* is open to the atmosphere.

A valve body urging spring 60 is accommodated in the second pressure chamber 55*b*. The spring 60 urges the pressure sensitive member 59 toward the first pressure chamber 55*a*. A valve body urging spring 61 is accommodated in the valve chamber 52. The spring 61 urges the operation rod 57 in a direction causing the valve body 57*a* to be seated on the valve seat 58. The right end of the operation rod 57 contacts the pressure sensitive member 59 and the displacement of the pressure sensitive member 59 is transferred to the valve body 57*a* of the operation rod 57.

When the suction pressure introduced to the first pressure chamber 55*a* becomes high, the pressure sensitive member 59 is displaced toward the second pressure chamber 55*b*. The operation rod 57 moves rightward and the opening size of the first supply passage 43 is decreased. Accordingly, the flow rate of high pressure refrigerant gas introduced to the crank chamber 12 from the discharge chamber 22 is decreased. The pressure in the crank chamber 12 is decreased and the displacement of the compressor is increased, and the suction pressure is lowered.

When the suction pressure introduced to the first pressure chamber 55*a* becomes low, the pressure sensitive member 59 is displaced toward the first pressure chamber 55*a*. The operation rod 57 moves leftward and the opening size of the first supply passage 43 is increased. Accordingly, the flow rate of high pressure refrigerant gas introduced to the crank chamber 12 from the discharge chamber 22 is increased. The pressure in the crank chamber 12 is increased and the displacement of the compressor is decreased, and the suction pressure becomes high. The first control valve CV1 automatically operates the operation rod 57 (valve body 57*a*) based on the suction pressure so that the displacement of the compressor is changed to cancel the fluctuation of the pressure.

As shown in FIG. 2, a first communication passage 72, a valve chamber 73 and a second communication passage 74 are defined in a valve housing 71 of the second control valve CV2. An upper end portion of an operation rod 75 is inserted to the second communication passage 74 so as to be movable in its axial direction (the vertical direction in the drawing). The first communication passage 72 is communicated with the discharge chamber 22 via an upstream section of the second supply passage 44. The valve chamber 73 is communicated with the crank chamber 12 at a downstream section of the second supply passage 44 via the common passage 45, which is an upstream section of the first bleed passage 41. The second communication passage 74 is communicated with the suction chamber 21 via a downstream section of the first bleed passage 41. The first communication passage 72 and the valve chamber 73 form a part of the second supply passage 44. The valve chamber 73 and the second communication passage 74 form a part of the first bleed passage 41.

A ball valve (a second valve body) 76 is accommodated in the valve chamber 73 so as to be moved upward and downward. In the housing 71, a step defined between the valve chamber 73 and the first communication passage 72 functions as a first valve seat 77. In the housing 71, a step defined between the valve chamber 73 and the second communication passage 74 functions as a second valve seat 78. A valve body urging spring 79 is accommodated in the valve chamber 73. The spring 79 urges the ball valve 76 toward the second valve seat 78.

In a state shown in FIG. 2, the ball valve 76 is in a first position. In the first position, the ball valve 76 is seated in the first valve seat 77 to shut off the first communication passage 72 (second supply passage 44), and the ball valve 76 is released from the second valve seat 78 to open the second communication passage 74 (first bleed passage 41). In a state shown in FIG. 4, the ball valve 76 is in a second position. In the second position, the ball valve 76 is released from the first valve seat 77 to open the first communication passage 72 (second supply passage 44), and the ball valve 76 is seated in the second valve seat 78 to shut off the second communication passage 74 (first bleed passage 41). The ball valve 76 has a first valve portion, which is an upper semispherical portion, and a second valve portion, which is a lower semispherical portion. The first valve portion adjusts the opening size of the second supply passage 44, and the second valve portion adjusts the opening degree of the first bleed passage 41.

An electromagnetic actuator 80 is arranged on a lower side of the valve housing 71. The second control valve CV2 is an electromagnetic valve. The electromagnetic actuator 80 has an accommodation cylinder 81 at a center of the valve housing 71. The accommodation cylinder 81 has a cylindrical shape having a bottom. A center post 82 is fixed in an upper opening of the accommodation cylinder 81. A plunger chamber 83 is defined by the insertion of the center post 82 at a lower portion of the accommodation cylinder 81.

A plunger 84 is accommodated in the plunger chamber 83 so as to be movable along its shaft. A guide hole 82*a* is formed at a center of the center post 82 so as to be extended along the shaft of the center post 82. The operation rod 75 is arranged in the guide hole 82*a* so as to be movable along its axis. The lower end of the operation rod 75 contacts the plunger 84 in the plunger chamber 83.

A spring 85 is provided between the center post 82 and the plunger 84 in the plunger chamber 83. The spring 85 urges the plunger 84 away from the center post 82. The operation rod 75 is urged toward the plunger 84 via the ball valve 76 by the valve body urging spring 79. Therefore, the plunger 84 moves up and down in synchronism with the operation rod 75.

A coil 86 is provided around the accommodation cylinder 81 so as to cover the center post 82 and the plunger 84. Electric power from a drive circuit 93 is supplied/stopped based on a command from a control computer 92 according to information from information detection means 91 including an air conditioner switch 91*a,* an acceleration pedal depression degree sensor 91*b,* and an engine speed sensor 91*c.* A battery (not shown) of a vehicle is used as an electric source.

Figure 4:
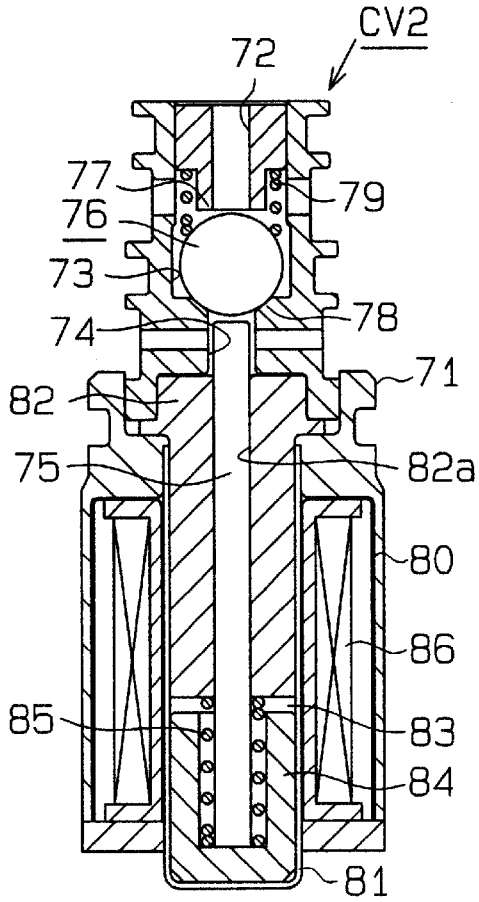
FIG. 4 is a cross-sectional view of the second control valve of FIG. 2 when electric power supply is stopped.

When the electric power is supplied from the drive circuit 93 to the coil 86, an electromagnetic force is generated between the center post 82 and the plunger 84. The electromagnetic force is transmitted to the operation rod 75 via the plunger 84. The operation rod 75 is moved to the top position against the urging force of the valve body urging spring 79 and the plunger urging spring 85 and the ball valve 76 is positioned in a first position (FIG. 2). When the electric power supply from the drive circuit 93 to the coil is stopped, the operation rod 75 is moved to the bottom position by the urging force of the valve body urging spring 79 and the plunger urging spring 85 and the ball valve 76 is positioned in a second position (FIG. 4).

Figure 3:
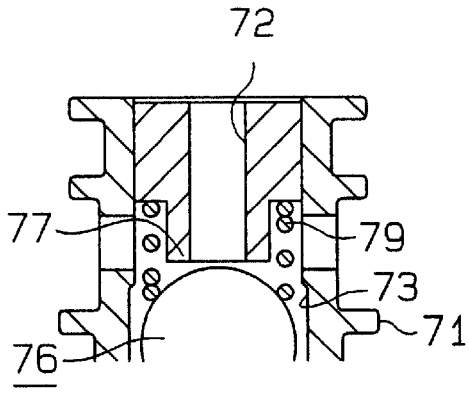
FIG. 3 is an enlarged partial cross-sectional view illustrating the second control valve of FIG. 2.

The ball valve 76 receives a load based on the difference between the pressure at the first communication passage 72 (the discharge chamber 22) and the pressure at the valve chamber 73 (the crank chamber 12). The load acts in a direction moving the ball valve 76 away from the first valve seat 77. The pressures act on the front and the rear of the second supply passage 44. Therefore, as shown in FIG. 3, when the difference between the pressure of the discharge chamber 22 and the pressure of the crank chamber 12 becomes great (for example, greater than or equal to 2.5 MPa) while the electric power is supplied to the electromagnetic actuator 80, the ball valve 76 moves down by the load based on the pressure difference against the electromagnetic force (load in the valve closing direction) and opens the second supply passage 44. The second control valve CV2 functions as a differential valve, which automatically operates according to the change of the difference between the pressure of the discharge chamber 22 and the pressure of the crank chamber 12 when the electric power is supplied to the electromagnetic actuator 80.

In the above compressor, the displacement is determined as follows.

When information of the acceleration pedal depression degree from the depression degree sensor 91*b* or information of the engine speed from the engine speed sensor 91*c* becomes greater than a predetermined value, the control computer 92 commands the drive circuit 93 to stop the electric power supply to the second control valve CV2 regardless of the on-off state of the air conditioner switch 91*a.* When the acceleration pedal depression degree information or the engine speed information is greater than the predetermined value, the engine E is highly loaded because of acceleration or an increased speed of the vehicle.

Therefore, the second control valve CV2 is switched to the second position as shown in FIG. 4. Accordingly, the second supply passage 44 is opened and the first bleed passage 41 is closed. As a result, high pressure refrigerant gas is introduced from the discharge chamber 22 to the crank chamber 12 via the second supply passage 44. The flow rate of the refrigerant gas is small since the refrigerant gas is introduced from the crank chamber 12 to the suction chamber 21 only by the second bleed passage 42. Therefore, the crank chamber 12 is highly pressured regardless of the displacement of the first control valve CV1, that is, regardless the opening size of the first supply passage. The displacement of the compressor is maintained minimum and the compressor drive load of the engine E becomes minimum.

When the displacement of the compressor is minimum, the pressure of the discharge chamber 22, which acts on the shutoff valve 34, is smaller than the predetermined value, which closes the shutoff valve 34. The refrigerant circulation via the external refrigerant circuit 30 is stopped. Therefore, even if the refrigerant gas is kept compressed by the compressor, the air conditioner is not operated and the air-conditioning function of the compressor is off.

The minimum inclination angle of the swash plate 15 is not zero. Therefore, when the displacement of the compressor becomes minimum, suction of the refrigerant gas from the suction chamber 21 to the compression chamber 30, compression of the refrigerant gas, and discharge of the refrigerant gas from the compression chamber 20 to the discharge chamber 22 are continued. In the compressor, a circuit of discharge chamber 22, the second supply passage 44, the crank chamber 12, the second bleed passage 42, the suction chamber 21, the compression chamber 20, and the discharge chamber 22 is formed. Lubricating oil is circulated with the refrigerant in the refrigerant circuit. Even if the refrigerant gas (lubricating oil) is not returned from the external refrigerant circuit 30, lubricating condition of each slidably moving portion of the compressor, for example, between the swash plate 15 and the shoe 18 is maintained optimally.

If the air conditioner switch 91*a* is on and the vehicle is not in a specific condition, the control computer 92 commands the drive circuit 93 to supply the electric power to the second control valve CV2. The specific condition is, for example, vehicle's acceleration or high speed running. Therefore, since the second control valve CV2 is switched to the first position and the second supply passage 44 is closed as shown in FIG. 2, the high pressure refrigerant gas is introduced from the discharge chamber 22 to the crank chamber 12 only by the first supply passage 43. The pressure in the crank chamber 12 is changed when the first control valve CV1 adjusts the opening size of the first supply passage 43. The displacement of the compressor is changed to cancel the fluctuation of the pressure.

When the second control valve CV2 is in the first position, the first bleed passage 41 is opened. Therefore, the refrigerant gas is introduced from the crank chamber 12 to the suction chamber 21 rapidly through the first and second bleed passages 41, 42. For example, when the air conditioner switch 91*a* is turned on from the off state, the pressure in the crank chamber 12 is rapidly decreased and the displacement of the compressor is increased. This improves starting performance of the air conditioner. That is, cold air is rapidly supplied to the passenger compartment of the vehicle.

If the discharge pressure of the compressor is extraordinarily high due to some reason, the second control valve CV2 functions as a differential valve to open the second supply passage 44 as shown in FIG. 3. Therefore, the flow rate of high pressure refrigerant introduced into the crank chamber 12 is increased, which increases the pressure in the crank chamber 12. Accordingly, the displacement of the compressor is decreased. When the displacement of the compressor is decreased, the discharge pressure is decreased. The refrigeration cycle apparatus is protected from excessively high discharge pressure.

The above-described embodiment has the following advantages.

(1) The second control valve CV2 closes the first bleed passage 41 at the minimum displacement of the compressor. Therefore, the flow rate of refrigerant gas introduced from the crank chamber 12 to the suction chamber 21 is decreased. The pressure in the crank chamber 12 is reliably increased to maintain the minimum displacement of the compressor with a small flow rate of high pressure refrigerant gas introduced to the crank chamber 12. Therefore, the minimum displacement of the compressor can be set small and the compressor drive load on the engine E is decreased. Since the first and second control valves CV1 and CV2 do not need a structure allowing a large flow rate of refrigerant gas, the valve structure for controlling displacement is minimized.

(2) The second control valve CV2 has a function for protecting the refrigeration cycle apparatus. Specifically, the second control valve CV2 mechanically senses excessive increase of the discharge pressure and prevents the pressure increase. Therefore, another valve for the protection function is not necessary and the structure of the compressor is simplified.

(3) The second supply passage 44 and the first bleed passage 41 have a common passage (common passage 45) between the second control valve CV2 and the crank chamber 12. Therefore, the passage structure is simplified compared to the case in which each of the passages 41 and 44 separately connects the second control valve CV2 and the crank chamber 12.

(4) Each of the two different spherical portions of the ball valve 76 of the second control valve CV2 functions as a valve body. Therefore, the structure of the second control valve CV2 is simplified compared to the case in which a first valve body for opening/closing the second supply passage 44 and a second valve body for opening/closing the first bleed passage 41 are separately provided. Since the ball valve 76 is a spherical shape, it is easy to assemble the ball valve 76 to the valve housing 71.

(5) The second control valve CV2 is moved to the second position, or the displacement of the compressor becomes minimum, when the electric power supply to the second control valve CV2 is stopped. The air conditioner switch 91*a* is off for longer time through one year than the time while the air conditioner switch 91*a* is on. The electric power is not supplied to the second control valve CV2 during the air conditioner switch 91*a* is off and the battery of the vehicle is saved.

(6) The second bleed passage 42, which is always open, is provided. Even if the second control valve CV2 is in the second position and the first bleed passage 41 is closed, circulation of the refrigerant gas (lubricating oil) in the compressor is maintained and the lubrication of each portion that slidably moves is maintained optimally. This structure facilitates the application of a clutchless type power transmission mechanism.

(7) Electromagnetic force from the electromagnetic actuator 80 acts on the ball valve 76 of the second control valve CV2 as pressure against the load based on the difference between the pressure of the discharge chamber 22 and the pressure of the crank chamber 12. That is, the electromagnetic actuator 80 is a push-type.

For example, if a pull type actuator is used as the electromagnetic actuator 80, a strong spring for urging the ball valve 76 against the load based on the difference between the pressure of the discharge chamber 22 and the pressure of the crank chamber 12. However, in this embodiment, such a spring is not necessary. The electromagnetic actuator 80 does not need a stronger spring to move the ball valve 76 to the second position against the strong spring when the electric power supply is stopped. Therefore, small electromagnetic force is sufficient, since the ball valve 76 is not necessary to be moved to the first position against the spring. As a result, the electromagnetic structure of the electromagnetic actuator 80 can be made compact, and the second control valve CV2 can be thus made compact.

It should be apparent to those skilled in the art that the present invention may be embodied in many other specific forms without departing from the spirit or scope of the invention. More particularly, the present invention may be modified as described below.

The first control valve CV1 is not limited to a valve that is operated according to the displacement of the suction pressure. Instead, the first control valve CV1 may be a valve that is operated according to the displacement of discharge pressure. The first control valve CV1 is not limited to a valve that is operated based on an absolute value of pressure of the refrigerant circuit. For example, the first control valve CV1 may be a valve that is operated to maintain a constant flow rate based on the pressure difference between a upstream point and a downstream point in the discharge pressure zone, that is, based on the flow rate of discharge refrigerant gas.

For example, a groove may be formed in the first valve seat 77 of the second control valve CV2 so that a small flow of refrigerant gas is generated in the second supply passage 44 when the second control valve CV2 is in the first position.

For example, a groove may be formed in the second valve seat 78 of the second control valve CV2 so that refrigerant having a small flow rate flows in the first bleed passage 41 when the second control valve CV2 is in the second position. In this case, the second bleed passage 42 may be omitted to simplify the passage structure.

The second control valve CV2 may be structured so that the second control valve CV2 is in the first position when the electric power supply to the electromagnetic actuator 80 is stopped, and the second control valve CV2 is in the second position when the electric power is supplied to the electromagnetic actuator 80.

For example, a switch for supplying and stopping electric power to the second control valve CV2 may be located in an electric power supply path between the electromagnetic actuator 80 and a power source. This switch may be coupled to the air conditioner switch 91*a* and turned on and off by manipulation of the air conditioner switch 91*a*.

The second control valve CV2 is not limited to an electromagnetic valve. For example, the second control valve CV2 may be a valve of a manual type that is coupled to the air conditioner switch 91*a* and is operated by manipulation of the air conditioner switch 91*a*.

The present invention may be embodied in a displacement control device of a variable displacement compressor of a wobble-plate type.

A power transmission mechanism with a clutch mechanism such as an electromagnetic clutch may be applied. In this case, when the air conditioner switch 91*a* is turned off (air conditioning is not necessary), the electromagnetic clutch is shut off. The shutoff valve 34 and the second bleed passage 42 may be omitted.

Even if the information of the acceleration pedal depression degree from the pedal depression degree sensor 91*b* or the information of the engine speed from the engine speed sensor 91*c* is greater than the predetermined value, the electromagnetic clutch may shut off to decrease the compressor drive load of the engine E. However, it is preferable to minimize the displacement of the compressor, or to switch the second control valve CV2 from the first position to the second position, when the engine E is in a condition of a high load. Thus, the shutoff valve 34 and the second bleed passage 42 may be omitted to simplify the circuit structure and the frequency of an on/off operation of the electromagnetic clutch becomes as small as possible, which improves the drivability. The second control valve CV2 may be an exclusive valve so that the compressor optimally copes with the high load of the engine E.

Therefore, the present examples and embodiments are to be considered as illustrative and not restrictive and the invention is not to be limited to the details given herein, but may be modified within the scope and equivalence of the appended claims.

What is claimed is:

1. A displacement control device for a variable displacement compressor in a refrigerant circuit of a vehicular air conditioner, wherein the compressor is driven by a drive source of the vehicle to compress refrigerant, wherein the refrigerant circuit includes a low pressure zone and a high pressure zone, the low pressure zone being exposed to the pressure of refrigerant drawn into the compressor, and the high pressure zone being exposed to the pressure of refrigerant compressed by the compressor, and wherein the displacement control device adjusts the pressure in a crank chamber of the compressor, thereby changing the displacement of the compressor, the control device comprising:

a bleed passage connecting the crank chamber with the low pressure zone;

a first supply passage and a second supply passage, wherein the first and second supply passages connect the crank chamber with the high pressure zone, and wherein the first and second supply passages are formed independent from each other;

a first control valve located in the first supply passage, wherein the first control valve adjusts the opening size of the first supply passage and includes a pressure sensitive member and a valve body, the pressure sensitive member being displaced in response to a pressure in the refrigerant circuit, the valve body being moved by the pressure sensitive member, wherein, in response to a pressure in the refrigerant circuit, the pressure sensitive member moves the valve body such that the displacement of the compressor is changed to cancel pressure fluctuation of a pressure in the refrigerant circuit; and a second control valve located in the second supply passage and in the bleed passage, wherein the second control valve operates in response to an external command and includes a first valve portion and a second valve portion, wherein the first valve portion adjusts the opening size of the second supply passage, and the second valve portion adjusts the opening size of the bleed passage, wherein, when the first valve portion decreases the opening size of the second supply passage, the second valve portion increases the opening size of the bleed passage, and wherein, when the first valve portion increases the opening size of the second supply passage, the second valve portion decreases the opening size of the bleed passage.

2. The control device according to claim 1, wherein the second control valve includes an actuator, wherein, based on the external command, the actuator urges the first valve portion in a direction closing the second supply passage.

3. The control device according to claim 2, wherein the actuator is an electromagnetic actuator, wherein, when electricity is supplied to the electromagnetic actuator, the first valve portion decreases the opening size of the second supply passage, and wherein, when electricity to the electromagnetic actuator is stopped, the first valve portion increases the opening size of the second supply passage.

4. The control device according to claim 2, wherein the first valve portion is urged in a direction opening the second supply passage by a force based on the difference between the pressure in the high pressure zone and the pressure in the crank chamber, and wherein, when the pressure difference is excessive, the first valve portion increases the opening size of the second supply passage against the urging force of the actuator.

5. The control device according to claim 1, wherein a section of the second supply passage between the second control valve and the crank chamber is also used as a section of the bleed passage between the second control valve and the crank chamber.

6. The control device according to claim 1, wherein the first valve portion and the second valve portion are formed in a single member.

7. The control device according to claim 6, wherein the single member is a spherical body.

8. The control device according to claim 1, wherein the compressor is always coupled to the drive source with a power transmission mechanism.

9. The control device according to claim 1, wherein the bleed passage is a first bleed passage, wherein, when the first valve portion closes the second supply passage, the second valve portion opens the first bleed passage, wherein, when the second valve portion closes the first bleed passage, the first valve portion opens the second supply passage, and wherein the control device further includes a second bleed passage, the second bleed passage always communicating the crank chamber with the low pressure zone.

10. The control device according to claim 8, wherein the minimum displacement of the compressor is greater than zero, wherein the refrigerant circuit includes a circulation stopping device, and wherein, when the displacement of the compressor is minimum, the circulation stopping device stops the circulation of refrigerant in the refrigerant circuit.

11. The control device according to claim 9, wherein the minimum displacement of the compressor is greater than zero, wherein the refrigerant circuit includes a circulation stopping device, and wherein, when the displacement of the compressor is minimum, the circulation stopping device stops the circulation of refrigerant in the refrigerant circuit.

12. The control device according to claim 1, wherein the pressure sensitive member moves the valve body in response to the pressure in the low pressure zone such that the displacement of the compressor is changed to cancel pressure fluctuation of the pressure in the low pressure zone.

13. A displacement control device for a variable displacement compressor in a refrigerant circuit of a vehicular air conditioner, wherein the compressor is driven by a drive source of the vehicle to compress refrigerant, wherein the refrigerant circuit includes a low pressure zone and a high pressure zone, the low pressure zone being exposed to the pressure of refrigerant drawn into the compressor, and the high pressure zone being exposed to the pressure of refrigerant compressed by the compressor, and wherein the displacement control device adjusts the pressure in a crank chamber of the compressor, thereby changing the displacement of the compressor, the control device comprising:

a bleed passage connecting the crank chamber with the low pressure zone;

a first supply passage and a second supply passage, wherein the first and second supply passages connect the crank chamber with the high pressure zone, and wherein the first and second supply passages are formed independent from each other;

a first control valve located in the first supply passage, wherein the first control valve adjusts the opening size of the first supply passage and includes a pressure sensitive member and a first valve body, the pressure sensitive member being displaced in response to a pressure in the refrigerant circuit, the first valve body being moved by the pressure sensitive member, wherein, in response to a pressure in the refrigerant circuit, the pressure sensitive member moves the first valve body such that the displacement of the compressor is changed to cancel pressure fluctuation of a pressure in the refrigerant circuit; and a second control valve located in the second supply passage and in the bleed passage, wherein the second control valve includes a second valve body and an electromagnetic actuator, wherein the second valve body adjusts the opening size of the second supply passage and the opening size of the bleed passage, wherein the electromagnetic actuator moves the second valve body, wherein the second valve body is moved between a first position and a second position, wherein, at the first position, the second valve body closes the second supply passage and opens the bleed passage, and wherein, at the second position, the second valve body opens the second supply passage and closes the bleed passage.

14. The control device according to claim 13, wherein, when electricity is supplied to the electromagnetic actuator, the second valve body is moved to the first position, and wherein, when electricity is stopped to the electromagnetic actuator, the second valve body is moved to the second position.

15. The control device according to claim 13, wherein the second valve body is urged toward the second position by a force based on the difference between the pressure in the high pressure zone and the pressure in the crank chamber, and wherein, when the pressure difference is excessive, the second valve body is moved to the second position against the urging force of the electromagnetic actuator.

16. The control device according to claim 13, wherein a section of the second supply passage between the second control valve and the crank chamber is also used as a section of the bleed passage between the second control valve and the crank chamber.

17. The control device according to claim 13, wherein the compressor is always coupled to the drive source with a power transmission mechanism.

18. The control device according to claim 13, wherein the bleed passage is a first bleed passage, and wherein the control device further includes a second bleed passage, the second bleed passage always communicating the crank chamber with the low pressure zone.

19. The control device according to claim 17, wherein the minimum displacement of the compressor is greater than zero, wherein the refrigerant circuit includes a circulation stopping device, and wherein, when the displacement of the compressor is minimum, the circulation stopping device stops the circulation of refrigerant in the refrigerant circuit.

20. The control device according to claim 18, wherein the minimum displacement of the compressor is greater than zero, wherein the refrigerant circuit includes a circulation stopping device, and wherein, when the displacement of the compressor is minimum, the circulation stopping device stops the circulation of refrigerant in the refrigerant circuit.

* * * * *